US012366024B2

(12) United States Patent
Lee et al.

(10) Patent No.: US 12,366,024 B2
(45) Date of Patent: Jul. 22, 2025

(54) LAUNDRY TREATMENT MACHINE AND LAUNDRY TREATMENT SYSTEM INCLUDING THE SAME

(71) Applicant: LG ELECTRONICS INC., Seoul (KR)

(72) Inventors: Danbi Lee, Seoul (KR); Minhyoung Kim, Seoul (KR); Bongsu Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 979 days.

(21) Appl. No.: 17/085,572

(22) Filed: Oct. 30, 2020

(65) Prior Publication Data

US 2021/0131008 A1 May 6, 2021

(30) Foreign Application Priority Data

Oct. 31, 2019 (KR) ..... 10-2019-0137912

(51) Int. Cl.
*D06F 33/42* (2020.01)
*D06F 103/18* (2020.01)
*D06F 105/08* (2020.01)

(52) U.S. Cl.
CPC ..... *D06F 33/42* (2020.02); *D06F 2103/18* (2020.02); *D06F 2105/08* (2020.02)

(58) Field of Classification Search
CPC .. D06F 33/42; D06F 2103/18; D06F 2105/08; D06F 33/47; D06F 34/05; D06F 2105/52; D06F 2105/54; D06F 2105/58; D06F 35/008; D06F 34/22; D06F 2103/42; D06F 33/52; D06F 34/28; D06F 39/082; D06F 39/087
USPC ..... 68/12.02
See application file for complete search history.

(56) References Cited

U.S. PATENT DOCUMENTS 5,353,612 A * 10/1994 Noguchi ..... D06F 33/32 68/12.02
6,065,170 A * 5/2000 Jang ..... D06F 39/087 68/12.27
2009/0260404 A1* 10/2009 Saito ..... D06F 39/08 68/20

(Continued)

FOREIGN PATENT DOCUMENTS

GB 2560032 A * 8/2018 ..... G01H 1/00
JP 2003-71185 A 3/2003

(Continued)

*Primary Examiner* — David G Cormier
*Assistant Examiner* — Thomas Bucci
(74) *Attorney, Agent, or Firm* — Birch, Stewart, Kolasch & Birch, LLP

(57) ABSTRACT

A laundry treatment machine includes: a washing tub; a motor configured to supply rotational force to the washing tub; a water level sensor configured to detect a water level of the washing tub; a communicator configured to transmit data to a server or receive data from the server; and a controller server configured to control to stop operation, when a drainage error is detected during drainage operation of the washing tub, and, when tub washing schedule information is received from the server through the communicator, to control to perform operation to wash the washing tub based on the tub washing schedule information.

9 Claims, 12 Drawing Sheets

(56) References Cited

U.S. PATENT DOCUMENTS

| | | | | |
|---|---|---|---|---|
| 2013/0077809 | A1* | 3/2013 | Park | D06F 34/28 381/332 |
| 2013/0239336 | A1* | 9/2013 | Kim | D06F 33/42 8/137 |
| 2014/0067131 | A1* | 3/2014 | Park | D06F 34/05 700/275 |
| 2019/0010648 | A1* | 1/2019 | Han | D06F 33/34 |
| 2019/0120725 | A1* | 4/2019 | Yoon | D06F 37/12 |
| 2020/0003659 | A1* | 1/2020 | Davies | G01R 21/133 |
| 2021/0193333 | A1* | 6/2021 | Nishimura | H04Q 9/00 |

FOREIGN PATENT DOCUMENTS

| | | | | |
|---|---|---|---|---|
| JP | 2011-234843 | A | 11/2011 | |
| JP | 2018-43031 | A | 3/2018 | |
| JP | 2019-154843 | A | 9/2019 | |
| KR | 10-0138027 | B1 | 6/1998 | |
| KR | 10-2019-0115562 | A | 10/2019 | |
| WO | WO-2019082544 | A1 * | 5/2019 | D06F 34/05 |

* cited by examiner

FIG. 9

| CREATE_DT (YYYY-MM-DD HH:MM:SS) | DEVICE_ID PRODUCT IDENTIFICATION INFORMATION | Error_Code FIELD INFORMATION FOR CHECKING WHETHER ERROR HAS OCCURRED IN THE PRODUCT |
|---|---|---|
| 2019-06-25 05:00:40 | xxx-xxx-xxx-xxx | 1 OE(DRAINAGE ERROR ) |
| 2019-06-27 04:15:32 | xxx-xxx-xxx-xxx | 0 No Error |
| 2019-04-01 17:03:50 | xxx-xxx-xxx-xxx | 2 IE(WATER SUPPLY ERROR) |

FIG. 11

| CREATE_DT ⬍ | SDS_ver1⬍ | SDS1_Error_Code⬍ | SDS1_Courseinfo ⬍ |
|---|---|---|---|
| 2019-08-06 19:43:48 | 16 | 0 | 19 |
| 2019-08-06 19:43:45 | 16 | 0 | 19 |
| 2019-08-06 19:43:41 | 16 | 0 | 19 |
| 2019-08-06 19:12:25 | 16 | 0 | 2 |
| 2019-08-06 19:41:48 | 16 | 0 | 15 |
| 2019-08-06 19:25:25 | 16 | 0 | 0 |
| 2019-08-06 19:17:05 | 16 | 0 | 15 |
| 2019-08-06 19:01:53 | 16 | 5 | 3 |
| 2019-08-06 19:43:22 | 16 | 0 | 0 |
| 2019-08-06 19:43:18 | 16 | 0 | 0 |
| 2019-08-06 19:44:32 | 16 | 0 | 0 |
| 2019-08-06 19:44:29 | 16 | 0 | 0 |
| 2019-08-06 19:01:52 | 16 | 0 | 0 |

LAUNDRY TREATMENT MACHINE AND LAUNDRY TREATMENT SYSTEM INCLUDING THE SAME

CROSS-REFERENCE TO RELATED APPLICATION

This application claims the priority benefit of Korean Patent Application No. 10-2019-0137912, filed on, 31 Oct. 2019 in the Korean Intellectual Property Office, the disclosure of which is incorporated herein by reference.

BACKGROUND OF THE INVENTION

1. Field of the Invention

The present disclosure relates to a laundry treatment machine and a laundry treatment system having the same.

Meanwhile, the present disclosure relates to a laundry treatment machine for automatically washing a washing tub after drainage error occurs, and a laundry treatment system having the same.

2. Description of the Related Art

A laundry treatment machine is an apparatus capable of rinsing, washing, dehydrating, drying, and the like with respect to laundry in a washing tub.

To this end, after water is put into the washing tub, the washing tub is rotated by a rotational force of a motor.

Meanwhile, in order to drain the water introduced into the washing tub, a separate drainage operation is performed, and performed through a drain pipe connected to the washing tub.

Meanwhile, when a drainage error occurs, the washing tub is contaminated due to water that is not drained. Accordingly, measures for the contamination is required.

SUMMARY OF THE INVENTION

The present disclosure has been made in view of the above problems, and provides a laundry treatment machine capable of automatically washing a washing tub after a drainage error occurs, and a laundry treatment system having the same.

In accordance with an aspect of the present disclosure, a laundry treatment machine includes: a washing tub; a motor configured to supply rotational force to the washing tub; a water level sensor configured to detect a water level of the washing tub; a communicator configured to transmit data to a server or receive data from the server; and a controller server configured to control to stop operation, when a drainage error is detected during drainage operation of the washing tub, and, when tub washing schedule information is received from the server through the communicator, to control to perform operation to wash the washing tub based on the tub washing schedule information.

In accordance with another aspect of the present disclosure, a laundry treatment machine includes: a washing tub; a motor configured to supply rotational force to the washing tub; a water level sensor configured to detect a water level of the washing tub; a communicator configured to transmit data to a server or receive data from the server; and a controller server configured to control to stop operation, when a drainage error is detected during drainage operation of the washing tub, and to control to perform operation to wash the washing tub based on tub washing schedule information.

In accordance with another aspect of the present disclosure, a laundry treatment system includes: a laundry treatment machine comprising a washing tub, a water level sensor configured to detect a water level of the washing tub, and a communicator configured to communicate with a server; and the server configured to receive water level sensor information from the laundry treatment machine, and to generate tub washing schedule information based on the water level sensor information, wherein the laundry treatment machine performs operation of washing the washing tub based on the tub washing schedule information when the tub washing schedule information is received from the server.

BRIEF DESCRIPTION OF THE DRAWINGS

The above and other objects, features and advantages of the present disclosure will be more apparent from the following detailed description in conjunction with the accompanying drawings, in which:

FIGS. 8 to 11 are diagrams for explaining the operating method of FIG. 6 or 7.

DETAILED DESCRIPTION OF THE PREFERRED EMBODIMENTS

Embodiments of the present disclosure are described with reference to the accompanying drawings in detail. With respect to constituent elements used in the following description, suffixes "module" and "unit" are given only in consideration of ease in the preparation of the specification, and do not have or serve as different meanings. Accordingly, the suffixes "module" and "unit" may be used interchangeably. Detailed descriptions of well-known functions and structures incorporated herein may be omitted to avoid obscuring the subject matter of the present disclosure.

Figure 1A:
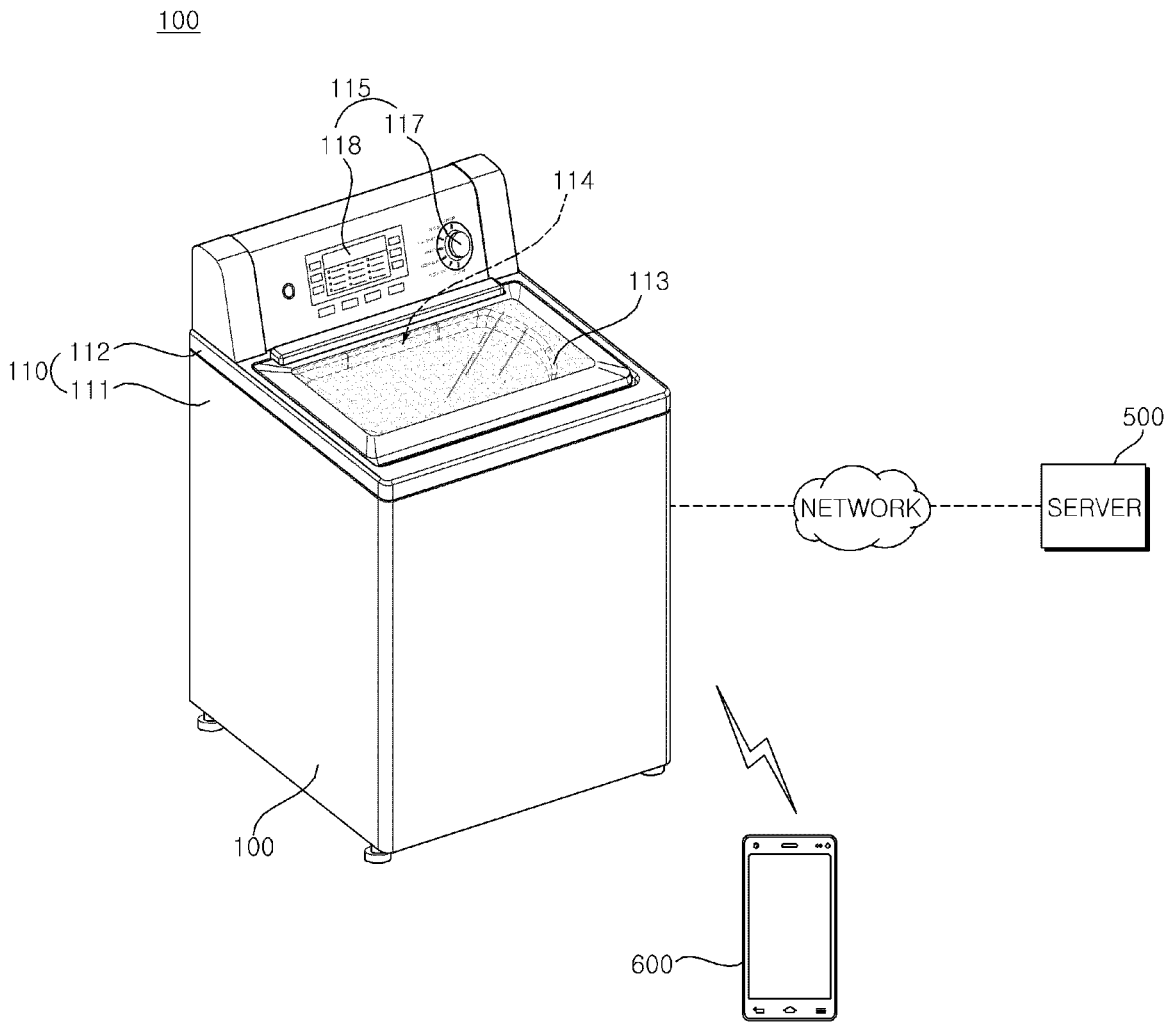
FIG. 1A is a perspective view illustrating a laundry treatment system according to an embodiment of the present disclosure.
Figure 1B:
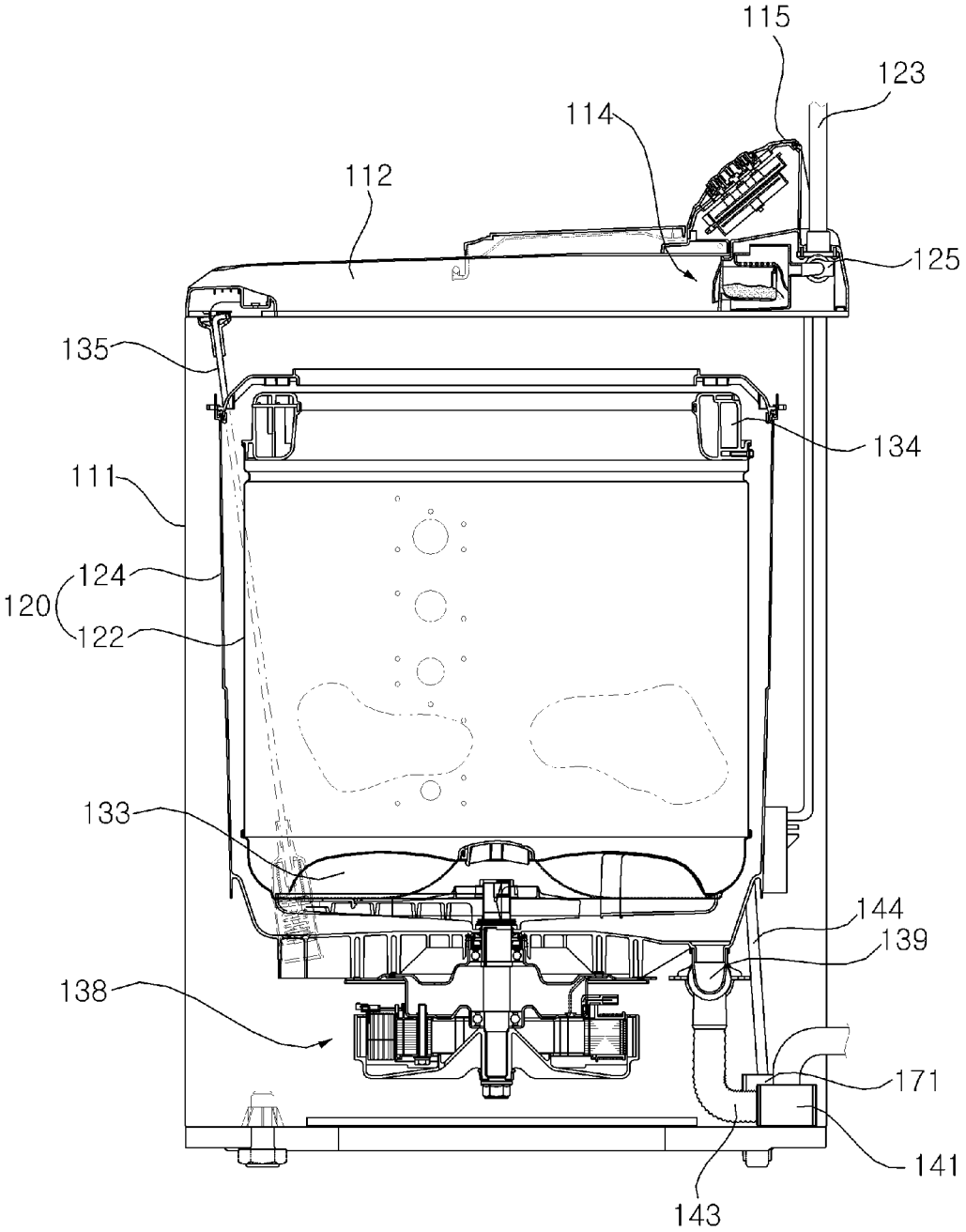
FIG. 1B is a side cross-sectional view of a laundry treatment machine of FIG. 1A.

FIG. 1A is a perspective view illustrating a laundry treatment system according to an embodiment of the present disclosure, and FIG. 1B is a side cross-sectional view of a laundry treatment machine of FIG. 1A.

Referring to FIGS. 1A to 1B, a laundry treatment system 10 according to an embodiment may include a laundry treatment machine 100, a server 500, and the like.

In addition, the laundry treatment system 10 according to an embodiment of the present disclosure may further include a mobile terminal 600, in addition to the laundry treatment machine 100 and the server 500.

The server 500 is a server provided by a manufacturer or the like. Based on data received from the laundry treatment machine 100, the server 500 may determine the state of the laundry treatment machine 100 through a learning based on machine learning or deep learning, generate data for operation of the laundry treatment machine 100 and provide to the laundry treatment machine 100 or the mobile terminal 600.

Deep Learning is an artificial intelligence technology that teaches a computer human being's way of thinking based on an artificial neural network (ANN) for constructing artificial intelligence, and is an artificial intelligence that can learn by itself like a human being even if a person doesn't teach. The artificial neural network (ANN) may be implemented in software or in the form of hardware such as a chip.

Meanwhile, the mobile terminal 600 is a mobile terminal registered in or linked to the laundry treatment machine 100, and may be a main user of the laundry treatment machine 100 or a mobile terminal of a corresponding family.

Meanwhile, when a drainage error is detected during the drainage operation of a washing tub 120 in the laundry treatment machine 100, the present disclosure controls to stop the operation, and allows to perform the operation of washing the washing tub 120 based on the tub washing schedule information when tub washing schedule information is received from the server 500 through a communicator 270. Accordingly, in the drainage error, it is possible to automatically wash the washing tub 120. In particular, according to the schedule information, it is possible to perform the washing of the washing tub 120 in the drainage error.

Meanwhile, the laundry treatment system 10 according to the embodiment of the present disclosure includes the server 500 that receives information of a water level sensor 121 from the laundry treatment machine 100, and generates tub washing schedule information based on the information of the water level sensor 121. When the tub washing schedule information from the server 500 is received, the laundry treatment machine 100 performs the operation of washing the washing tub 120 based on the tub washing schedule information. Accordingly, it is possible to automatically wash the washing tub 120 in the drainage error. This will be described in more detail with reference to FIG. 6 and below.

Meanwhile, the laundry treatment machine 100 conceptually includes a washing machine that receives a cloth to perform washing, rinsing, dehydration, and the like, a dryer that receives a wet cloth to perform drying, or the like. Hereinafter, it will be described based on the washing machine.

The washing machine 100 includes a casing 110 for forming an outer shape, a control panel 115 that provides a user interface by including manipulation keys for receiving various control commands from a user and a display for displaying information on an operation state of the washing machine 100, and the like, and a door 113 that is rotatably provided in the casing 110 and opens and closes an loading hole through which laundry is loaded.

The casing 110 may include a main body 111 forming a space in which various components of the washing machine 100 can be accommodated, and a top cover 112 which is provided in an upper side of the main body 111 and forms a cloth loading hole so that laundry can be introduced into an inner tub 122.

It is illustrated that the casing 110 includes the main body 111 and the top cover 112. However, it is sufficient for the casing 110 to form an outer shape of the washing machine 100 and the present disclosure is not limited thereto.

Meanwhile, it is illustrated that a support rod 135 is coupled to the top cover 112 which is one of the components forming the casing 110, but it is not limited thereto, and it should be noted that the support rod 135 can be coupled to any part of the fixed portion of the casing 110.

The control panel 115 may include manipulation keys 117 for manipulating the operating state of the laundry treatment machine 100, and a display 118 that is disposed in one side of the manipulation keys 117 and displays the operating state of the laundry treatment machine 100.

The door 113 may open and close a cloth loading hole (not shown) formed in the top cover 112, and may include a transparent member such as tempered glass so that the inside of the main body 111 can be seen.

The washing machine 100 may include a washing tub 120. The washing tub 120 may include an outer tub 124 in which washing water is contained, and an inner tub 122 rotatably provided in the outer tub 124 to accommodate laundry. A balancer 134 may be provided in an upper portion of the washing tub 120 to compensate for an eccentricity generated when the washing tub 120 rotates.

Meanwhile, the washing machine 100 may include a pulsator 133 rotatably provided in the lower portion of the washing tub 120.

A driving apparatus 138 provides a driving force for rotating the inner tub 122 and/or the pulsator 133.

The washing machine 100 may include a clutch (not shown) for selectively transmitting driving force of the driving apparatus 138 to rotate only the inner tub 122, to rotate only the pulsator 133, or to rotate the inner tub 122 and the pulsator 133 simultaneously.

Figure 2:
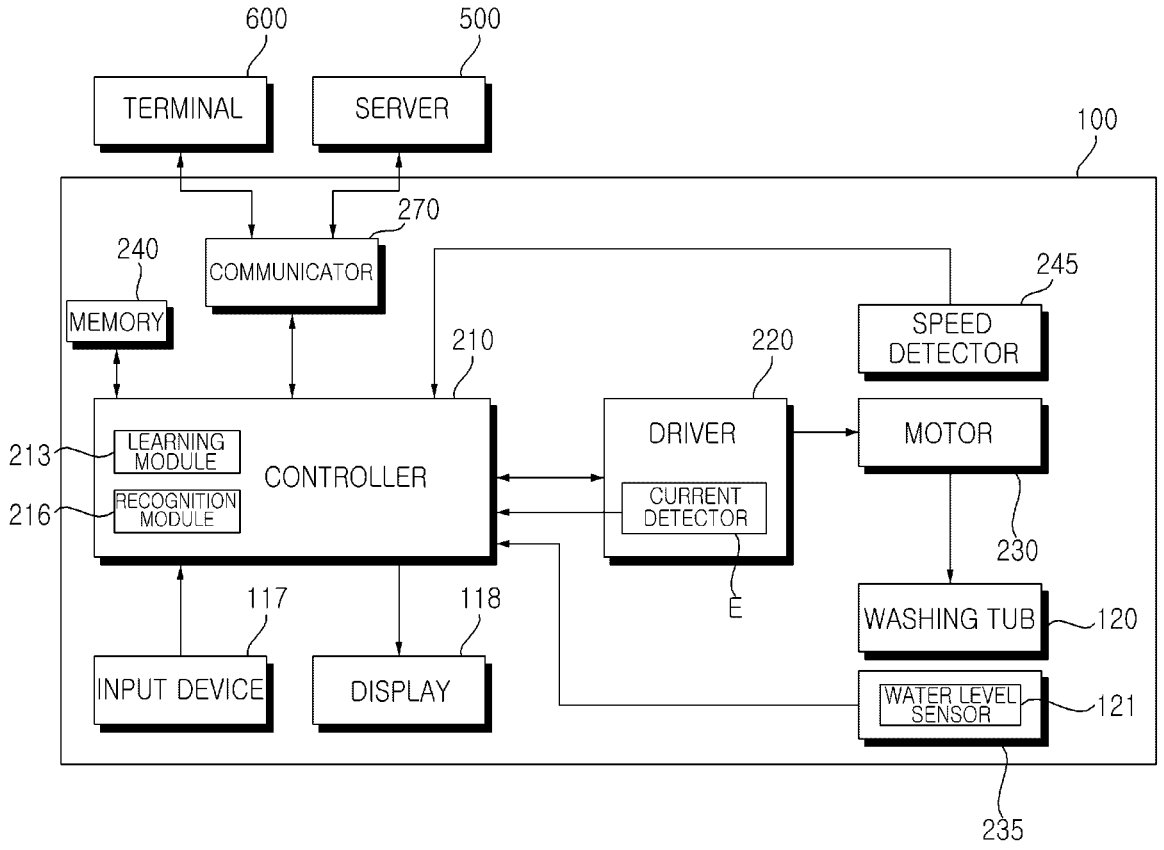
FIG. 2 is an internal block diagram of the laundry treatment machine of FIG. 1A.

Meanwhile, the driving apparatus 138 is operated by a driver 220 of FIG. 2, i.e., by a drive circuit. This will be described later with reference to FIG. 2 and below.

Meanwhile, the top cover 112 is provided with a detergent box 114 for accommodating various additives, such as laundry detergent, fabric softener and/or bleaching agent to be retractable, and washing water supplied through a water supply flow path 123 is supplied into the inner tub 122 after passing through the detergent box 114.

A plurality of holes (not shown) are formed in the inner tub 122, and the washing water supplied to the inner tub 122 flows to the outer tub 124 through the plurality of holes. A water supply valve 125 that intermits a water supply flow path 123 may be provided.

The washing water in the outer tub 124 is drained through a drain flow path 143, and a drain valve 139 for intermitting the drain flow path 143 and a drain pump 141 for pumping the washing water may be provided.

In addition, a circulation pump 171 for pumping the washing water may be provided in the end of the drain flow path 143. Washing water pumped from the circulation pump 171 may be introduced again into the washing tub 120 through a circulation flow path 144.

The support rod 135 is for suspending the outer tub 124 in the casing 110. One end of the support rod 135 is connected to the casing 110, and the other end is connected to the outer tub 124 by a suspension 150.

The suspension 150 buffers the vibration of the outer tub 124 during the operation of the washing machine 100. For example, the outer tub 124 may vibrate due to vibration that is generated as the inner tub 122 rotates, and vibration due to various factors such as the eccentricity of the laundry accommodated in the inner tub 122, the rotation speed of the inner tub 122, or the resonance characteristics can be buffered while the inner tub 122 rotates.

FIG. 2 is an internal block diagram of the laundry treatment machine of FIG. 1A.

Referring to the drawing, the laundry treatment machine 100 may include a motor 230 for rotating the washing tub 120, a driver 220 for driving the motor 230, a communicator 270, an input device 117, a display 118, a controller 210 for controlling each component or device in the laundry treatment machine 100, a speed detector 245, and a sensor 235 including a water level sensor 121.

The input device 117 may be provided with manipulation keys (power key, operation pause key, etc.) for manipulating the laundry treatment machine 100.

Meanwhile, the input device 117 may further include a microphone (not shown) for user voice recognition.

The display 118 displays the operation state of the laundry treatment machine 100.

For example, the display 118 may display operation course information during operation of the laundry treatment machine 100.

A memory 240 may store a programmed artificial neural network, current patterns for each cloth amount and/or each cloth quality, a database DB built through machine learning based on the current pattern, a machine learning algorithm, a current output current value detected by an output current detector E, an average value of the current output current values, a value obtained by processing the average values according to a parsing rule, data transmitted and received through the communicator 270, and the like.

In addition, the memory 240 may store various control data for controlling the overall operation of the laundry treatment machine, drying setting data inputted by a user, drying time calculated according to the drying setting, data related to drying course, data for determining occurrence of an error of the laundry treatment machine, and the like.

The communicator 270 may communicate with an external mobile terminal 600 or a server 500.

To this end, the communicator 270 may include one Or more communication modules, such as an internet module and a mobile communication module. The communicator 270 may receive various data such as learning data, algorithm update, and the like from the server.

The controller 210 may update the memory 240 by processing various data received through the communicator 270.

For example, when the data inputted through the communicator 270 is update data for an operation program previously stored in the memory 240, the data is updated in the memory 240 using the input data. When the input data is a new operation program, it may be additionally stored in the memory 240.

Deep Learning is a method that teaches a computer human being's way of thinking based on an artificial neural network (ANN) for constructing artificial intelligence, and is an artificial intelligence that can learn by itself like a human being even if a person doesn't teach. The artificial neural network (ANN) may be implemented in software or in the form of hardware such as a chip.

The laundry treatment machine 100 processes the current values detected by the output current detector E based on machine learning, thereby grasping the characteristics (hereinafter, referred to as "cloth characteristics") of the laundry (cloth) introduced into the washing tub 120. Such a cloth characteristics may include, for example, the amount of cloth and the state of cloth (hereinafter, referred to as "cloth quality"), and the controller 210 may determine the cloth quality for each cloth amount based on machine learning.

The controller 210 may use the current output current value detected by the output current detector E until it reaches the target speed as an input data of the artificial neural network previously learned by machine learning, thereby detecting a cloth amount.

Meanwhile, the controller 210 may control the motor driver 220.

The motor driver 220 drives the motor 230. Accordingly, the washing tub 120 is rotated by the motor 230.

The controller 210 receives an operation signal from the input device 117 and operates. Thus, the drying process can be performed.

In addition, the controller 210 may control the display 118 to display a washing course, a rinsing course, a dehydration course, or a current operation state, and the like.

Meanwhile, the controller 210 controls the motor driver 220, and the motor driver 220 controls the motor 230 to operate.

The motor driver 220 drives the motor 230, and may include an inverter (not shown), an inverter controller (not shown), and an output current detector (E of FIG. 3) which detects an output current flowing through the motor 230. In addition, the motor driver 220 may further include a converter for supplying a DC power input to an inverter (not shown).

For example, the inverter controller (430 of FIG. 3) in the motor driver 220 estimates the rotor position of the motor 230 based on the output current io. Then, the inverter controller 430 controls the motor 230 to rotate, based on the estimated rotor position.

Specifically, the inverter controller (430 of FIG. 3) generates a switching control signal (Sic of FIG. 3) of the pulse width modulation (PWM) method based on the output current io, and outputs to an inverter (not shown). Then, the inverter (not shown) performs a high speed switching operation to supply AC power of a certain frequency to the motor 230. The motor 230 is rotated by the AC power of a certain frequency.

The motor driver 220 will be described later with reference to FIG. 3.

Meanwhile, the controller 210 may detect the cloth amount, based on the current io detected by the current detector 220. For example, while the washing tub 120 rotates, the amount of quantity may be detected based on the current value io of the motor 230.

Meanwhile, the controller 210 may perform learning and recognition by the machine learning and, to this end, may include a learning module 213 and a recognition module 216.

The speed detector 245 may include a hole sensor for detecting a rotor position of the motor, inside or outside the motor 230. Accordingly, the speed detector 245 may be referred to as a position detector.

Meanwhile, a position signal H output from the speed detector 245 is input to the controller 210, and the controller 210 can detect the speed of the motor 230 based on the position signal H.

Figure 3:
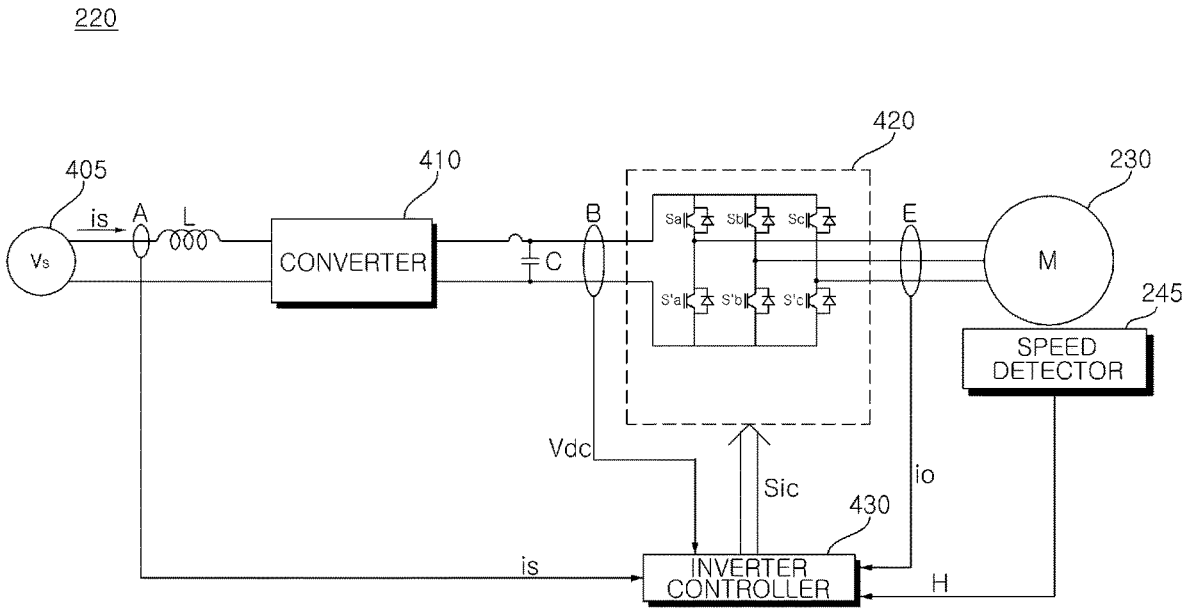
FIG. 3 is an internal circuit diagram of a motor driver of FIG. 2.

FIG. 3 is an internal circuit diagram of a motor driver of FIG. 2.

Referring to the drawing, the motor driver 220 according to an embodiment of the present disclosure is used to drive a sensorless type motor, and may include a converter 410, an inverter 420, an inverter controller 430, a DC terminal voltage detector B, a smoothing capacitor C, an output current detector E, and an output voltage detector F. In addition, the motor driver 220 may further include an input current detector A, a reactor L, and the like.

The reactor L is disposed between a commercial AC power supply Vs 405 and the converter 410 to perform a power factor correction or a boost operation. In addition, the reactor L may serve to limit harmonic current due to a fast switching of the converter 410.

The input current detector A may detect the input current inputted from the commercial AC power 405. To this end, a current transformer (CT), a shunt resistor, or the like may be used as the input current detector A. The detected input current is a discrete signal in the form of a pulse, and may be input to the inverter controller 430.

The converter 410 converts the commercial AC power 405 which passed through the reactor L into a DC power, and outputs the DC power. Although the commercial AC power 405 is shown as a single phase AC power in the drawing, it may be a three phase AC power. The internal structure of the converter 410 is also changed according to the type of the commercial AC power 405.

Meanwhile, the converter 410 may be formed of a diode or the like without a switching element, and may perform rectification operation without a separate switching operation.

For example, in the case of a single-phase AC power, four diodes may be used in the form of a bridge, and in the case of a three-phase AC power, six diodes may be used in the form of a bridge.

Meanwhile, the converter 410 may use, for example, a half-bridge type converter where two switching elements and four diodes are connected, and may use six switching elements and six diodes in the case of a three-phase AC power.

When the converter 410 includes a switching element, the boosting operation, the power factor improvement, and the DC power conversion may be performed by a switching operation of a corresponding switching element.

The smoothing capacitor C smoothes and stores the input power. In the drawing, a single element is illustrated as the smoothing capacitor C, but a plurality of elements may be provided to ensure device stability.

Meanwhile, in the drawing, it is illustrated as being connected to the output terminal of the converter 410, but not limited thereto, and a direct current power may be input directly. For example, a direct current power from a solar cell may be directly input to the smoothing capacitor C or may be DC/DC converted and inputted. Hereinafter, a portion illustrated in the drawing will be mainly described.

Meanwhile, since DC power is stored in both ends of the smoothing capacitor C, this may be referred to as a DC terminal or a DC link terminal.

The DC terminal voltage detector B may detect a voltage Vdc of DC terminal that is both ends of the smoothing capacitor C. To this end, the DC terminal voltage detector B may include a resistor, an amplifier, and the like. The detected DC terminal voltage Vdc is a discrete signal in the form of a pulse, and may be inputted to the inverter controller 430.

The inverter 420 includes a plurality of inverter switching elements, converts the DC power Vdc smoothed due to the turning on/off operation of the switching element into three-phase AC power va, vb, vc of a certain frequency, and may output to the three phase synchronous motor 230.

In the inverter 420, upper arm switching elements Sa, Sb, Sc and lower arm switching elements S'a, S'b, S'c which are connected in series with each other form a pair, and a total of three pairs of upper and lower arm switching elements are connected in parallel with each other Sa&S'a, Sb&S'b, Sc&S'c. Diodes are connected in anti-parallel to each of the switching elements Sa, S'a, Sb, S'b, Sc, and S'c.

The switching elements in the inverter 420 perform on/off operation of each of the switching elements based on the inverter switching control signal Sic from the inverter controller 430. Thus, the three-phase AC power having a certain frequency is output to the three-phase synchronous motor 230.

The inverter controller 430 may control a switching operation of the inverter 420 based on a sensorless method. To this end, the inverter controller 430 may receive an output current io detected by the output current detector E and an output voltage vo detected by the output voltage detector F.

The inverter controller 430 outputs an inverter switching control signal Sic to the inverter 420 so as to control the switching operation of the inverter 420. The inverter switching control signal Sic is a switching control signal of the pulse width modulation (PWM) method, and is generated and outputted based on the output current io detected by the output current detector E and the output voltage vo detected by the output voltage detector F. A detailed operation of the output of the inverter switching control signal Sic in the inverter controller 430 will be described later with reference to FIG. 4.

The output current detector E detects the output current io flowing between the inverter 420 and the three-phase motor 230. That is, the output current detector E detects the current flowing through the motor 230. The output current detector E may detect all of the output currents ia, ib, and ic of each phase, or may detect the output currents of two phases by using three-phase equilibrium.

The output current detector E may be positioned between the inverter 420 and the motor 230, and a current transformer (CT), a shunt resistor, or the like may be used for current detection.

When a shunt resistor is used, three shunt resistors can be positioned between the inverter 420 and the synchronous motor 230, or one end of three shunt resistors can be connected to three lower arm switching elements S'a, S'b, S'c of the inverter 420 respectively. Meanwhile, two shunt resistors can also be used by using three-phase equilibrium. Meanwhile, when a single shunt resistor is used, a corresponding shunt resistor can be disposed between the above-described capacitor C and the inverter 420.

The detected output current io is a discrete signal in the form of a pulse and may be applied to the inverter controller 430, and the inverter switching control signal Sic is generated based on the detected output current io. Hereinafter, it may be described in parallel that the detected output current io is the three-phase output current ia, ib, ic.

Meanwhile, the three-phase motor 230 is provided with a stator and a rotor, and the rotor rotates as each phase AC power of a certain frequency is applied to the coil of the stator of each phase (a, b, c phase).

Such a motor 230 may include, for example, a Surface-Mounted Permanent-Magnet Synchronous Motor (SMPMSM), an Interior Permanent Magnet Synchronous Motor (IPMSM), and a Synchronous Reluctance Motor (Synrm), and the like. Among these, SMPMSM and IPMSM are a permanent magnet synchronous motor (PMSMs) to which permanent magnet is applied, and Synrm has no permanent magnet.

Meanwhile, when the converter 410 includes a switching element, the inverter controller 430 may control the switching operation of the switching element in the converter 410. To this end, the inverter controller 430 may receive an input current detected by the input current detector A. In addition, the inverter controller 430 may output the converter switching control signal Scc to the converter 410 so as to control the switching operation of the converter 410. Such a converter switching control signal Scc is a switching control signal of a pulse width modulation (PWM) method, and may be generated and outputted based on the input current detected from the input current detector A.

Figure 4:
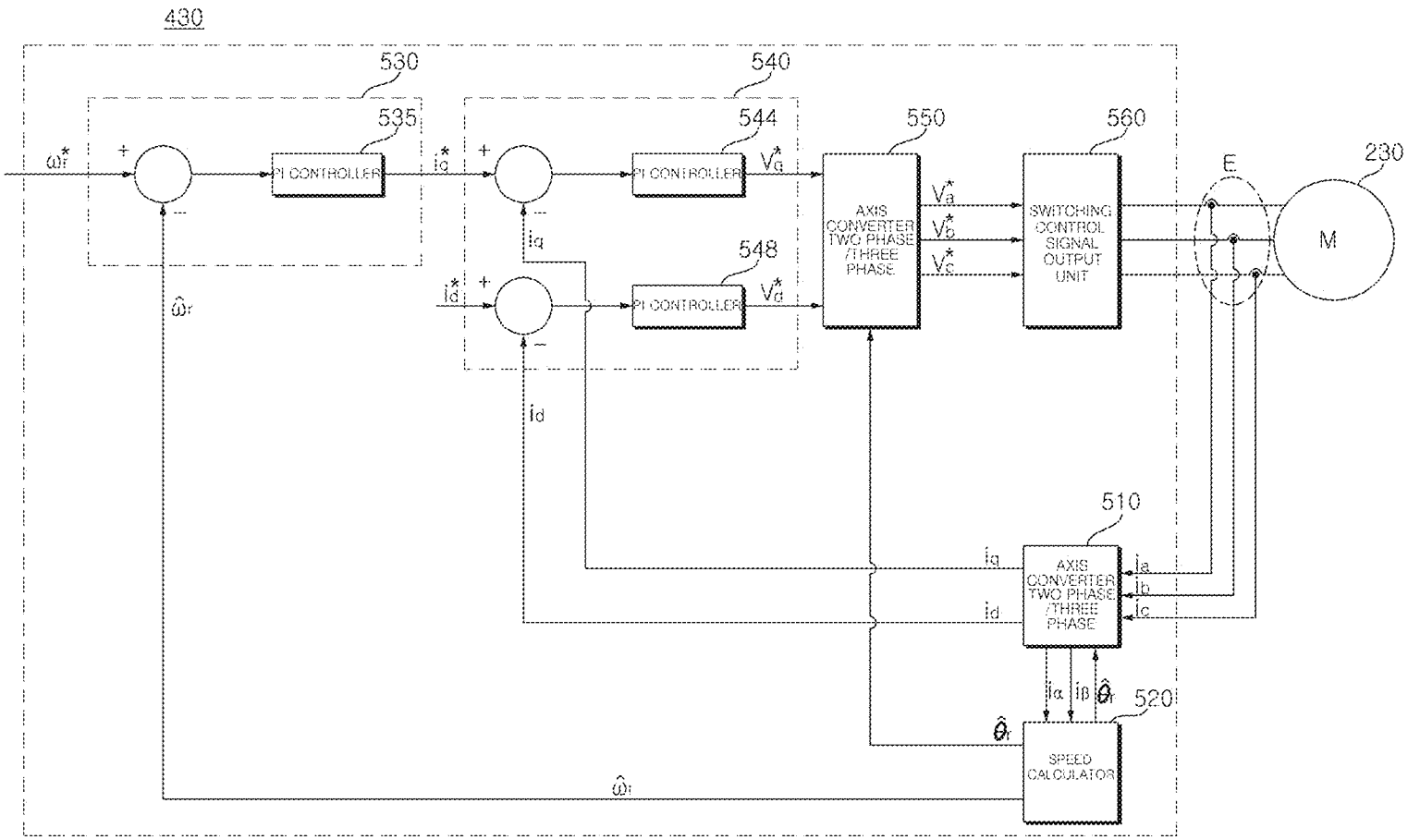
FIG. 4 is an internal block diagram of an inverter controller of FIG. 3.

FIG. 4 is an internal block diagram of an inverter controller of FIG. 3.

Referring to FIG. 4, the inverter controller 430 may include an axis converter 510, a speed calculator 520, a current command generator 530, a voltage command generator 540, an axis converter 550, and a switching control signal output unit 560.

The axis converter 510 receives the output current ia, ib, ic detected by the output current detector E, and may convert into two-phase current ia, iβ of stationary coordinate system, and two-phase current id, iq of rotary coordinate system. In this case, id may indicate the magnetic flux current of the motor 230, and iq may indicate the torque current of the motor 230.

Meanwhile, the axis converter 510 may output the two-phase current iα, iβ of the stationary coordinate system and the two-phase voltage vα, vβ of stationary coordinate system, and the two-phase current id, iq of the rotary coordinate system and the two-phase voltage vd, vq of the rotary coordinate system, which are converted, to the outside.

The speed calculator 520 receives the two-phase current iα, iβ of the stationary coordinate system and the two-phase voltage vα, vβ of the stationary coordinate system, which are axis-converted, from the axis converter 510, and may calculate the rotor position θ and the speed ω of the motor 230.

Meanwhile, the current command generator 530 generates a current command value i*q, based on a operation speed $\hat{\omega}$, and a speed command value ω*r. For example, the current command generator 530 performs a PI control in a PI controller 535, based on a difference between the operation speed $\hat{\omega}$, and the speed command value ω*r, and may generate the current command value i*q. In the drawing, a q-axis current command value i*q is illustrated as a current command value, but it is possible to generate a d-axis current command value i*d together, unlike the drawing. Meanwhile, the value of the d-axis current command value i*d may be set to zero.

Meanwhile, the current command generator 530 may further include a limiter (not shown) for limiting the level so that the current command value i*q does not exceed an allowable range.

Next, the voltage command generator 540 may generate the d-axis, q-axis voltage command values v*d, v*q, based on the d-axis, q-axis currents id, iq which are axis-converted into two-phase rotary coordinate system in the axis converter, and the current command value i*d, i*q in the current command generator 530, and the like. For example, the voltage command generator 540 performs PI control in the PI controller 544, and generates the q-axis voltage command value v*q, based on a difference between the q-axis current iq and the q-axis current command value i*q. In addition, the voltage command generator 540 performs PI control in the PI controller 548, and may generate the d-axis voltage command value v*d, based on a difference between the d-axis current id and a d-axis current command value i*d. Meanwhile, the value of the d-axis voltage command value v*d may be set to 0, in correspondence with the case where the value of the d-axis current command value i*d is set to zero.

Meanwhile, the voltage command generator 540 may further include a limiter (not shown) for limiting the level so that the d-axis, q-axis voltage command values v*d, q do not exceed an allowable range.

Meanwhile, the generated d-axis, q-axis voltage command value v*d, may be input to the axis converter 550.

The axis converter 550 receives the calculation position $\hat{\theta}_r$, the d-axis, q-axis voltage command values v*d, v*q from the speed calculator 520 to perform axis conversion.

First, the axis converter 550 performs conversion from the two-phase rotary coordinate system to the two-phase stationary coordinate system. In this case, the calculation position $\hat{\theta}$, may be used in the speed calculator 520.

The axis converter 550 converts the two-phase stationary coordinate system into the three-phase stationary coordinate system. Through this conversion, the axis converter 1050 may output the three-phase output voltage command value v*a, v*b, v*c.

The switching control signal output unit 560 generates and outputs an inverter switching control signal Sic according to the pulse width modulation PWM method based on the three-phase output voltage command value v*a, v*b, v*c.

The outputted inverter switching control signal Sic may be converted into a gate driving signal by a gate driver (not shown) and input to the gate of each switching element in the inverter 420. Thus, each of the switching elements Sa, S'a, Sb, S'b, Sc, S'c in the inverter 420 may perform a switching operation.

Figure 5:
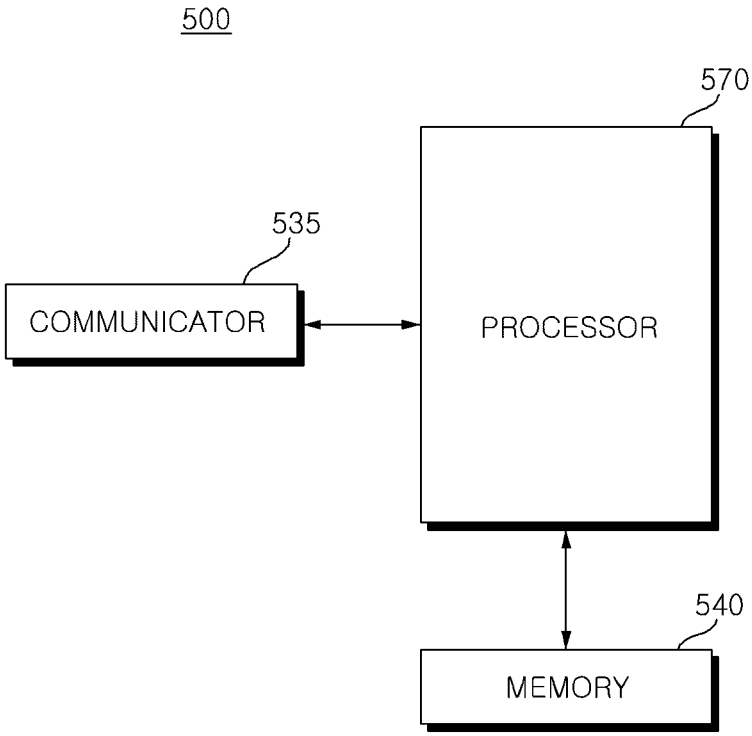
FIG. 5 is an internal block diagram of a server of FIG. 1A.

FIG. 5 is an internal block diagram of a server of FIG. 1A.

Referring to the drawing, the server 500 may include a communicator 535, a processor 570, and a memory 540.

The communicator 535 may receive data from an external electronic device or transmit data.

For example, the communicator 535 may receive sensed data from the laundry treatment machine 100 of FIG. 1A.

More specifically, the communicator 535 may receive water level sensor information from the laundry treatment machine 100 of FIG. 1A.

Meanwhile, the communicator 535 may transmit tub washing schedule information to the laundry treatment machine 100.

Meanwhile, the communicator 535 may transmit the tub washing schedule information to the mobile terminal 600.

The memory 540 may store data necessary for operating the server 500.

For example, the memory 540 may store at least one prediction model to be performed by the server 500. In this case, the prediction model may include at least one of a general linear model (GLM), an artificial neural network (ANN) based on a deep neural network, and a Gaussian process (GP).

Meanwhile, the memory 540 may store the water level sensor information from the laundry treatment machine 100.

Meanwhile, the processor 570 may perform overall operation control of the server 500.

Meanwhile, the processor 570 may generate tub washing schedule information based on the water level sensor information of the laundry treatment machine 100.

Meanwhile, the processor 570 may determine whether there is a drainage error, based on the water level sensor information of the laundry treatment machine 100 and drainage completion time information.

For example, when a certain time or more is elapsed after the drainage operation, and the water level of the laundry treatment machine 100 is higher than or equal to a certain water level, the processor 570 may determine that drainage is not smoothly performed but a drainage error is occurred.

Accordingly, when it is determined that drainage error occurs, the processor 570 may determine that contamination of the washing tub 120 of the laundry treatment machine 100 occurs.

In particular, the processor 570 may determine that the degree of contamination of the washing tub 120 of the laundry treatment machine 100 increases, as time passes from a time point of the occurrence of drainage error.

Accordingly, the processor 570 may generate the tub washing schedule information for washing the washing tub 120 so as to remove contamination of the washing tub 120 due to a drainage error.

For example, the processor 570 may bring the schedule in the tub washing schedule information forward, as the contamination of the washing tub 120 becomes worse.

Meanwhile, based on the received water level sensor information, the processor 570 grasps the state of the laundry treatment machine 100 through the machine learning or deep learning based learning, generate data for the operation of the laundry treatment machine 100, and provide the generate data to the laundry treatment machine 100, the mobile terminal 600, or the like.

For example, when determining a subsequent drainage error by using the tub washing schedule information at the time of determining a first drainage error, based on the received water level sensor information, the processor 570 can quickly generate and output the tub washing schedule information through machine learning or deep learning based learning.

Figure 6:
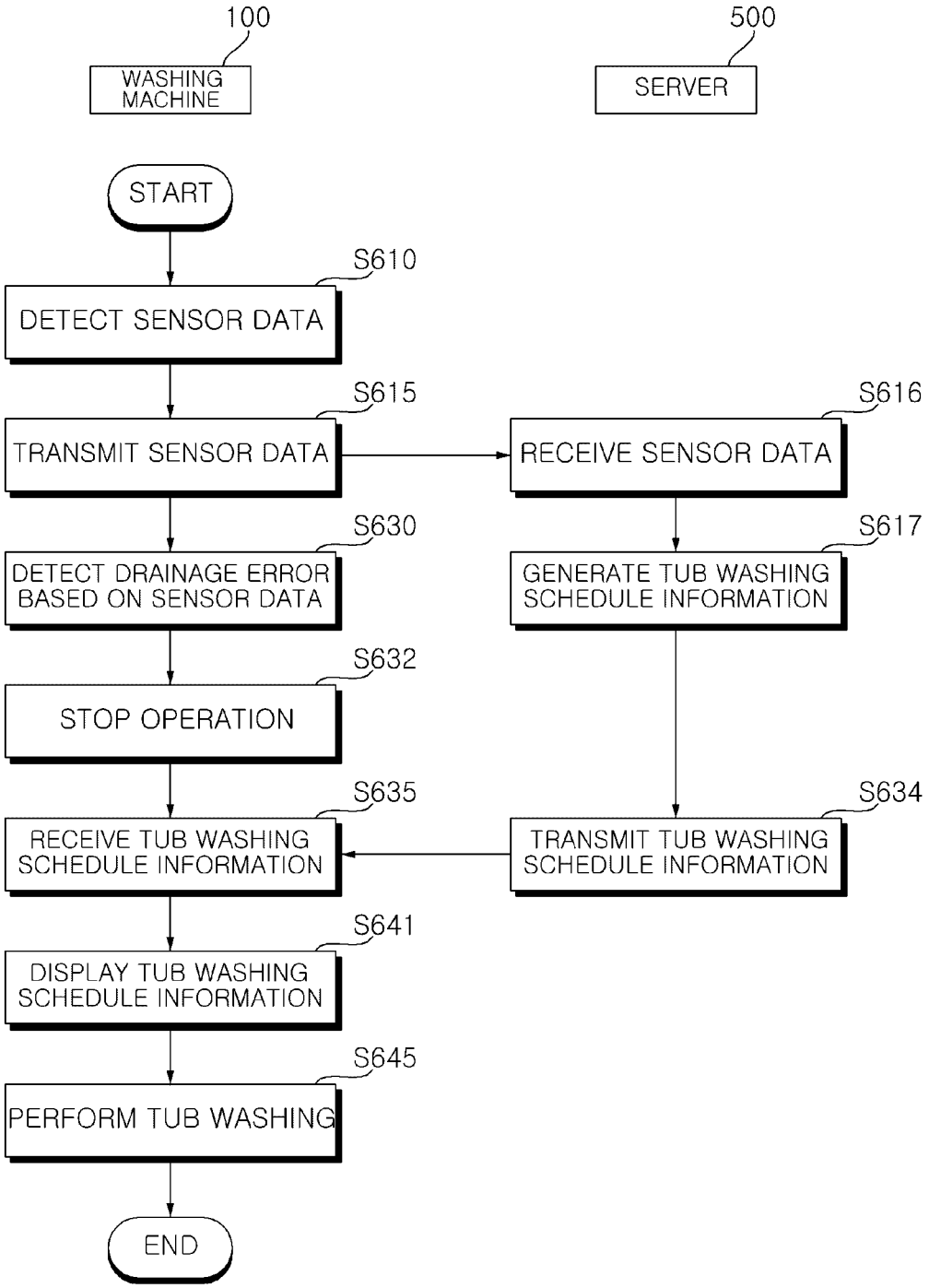
FIG. 6 is a flowchart illustrating a method of operating a laundry treatment system according to an embodiment of the present disclosure.

FIG. 6 is a flowchart illustrating a method of operating a laundry treatment system according to an embodiment of the present disclosure.

Referring to the drawing, the sensor 235 of the laundry treatment machine 100 detects sensor data in the laundry treatment machine 100 (S610).

For example, the water level sensor 121 in the sensor 235 of the laundry treatment machine 100 may output water level sensor data in the washing tub.

Next, the communicator 270 of the laundry treatment machine 100 may transmit at least a part of the sensor data detected by the sensor 235 to the server 500 (S615).

At this time, the communicator 270 of the laundry treatment machine 100 may transmit the water level sensor data to the server 500.

Meanwhile, the controller 210 of the laundry treatment machine 100 may determine whether drainage error occurs, based on the sensor data detected by the sensor 235, and may detect the drainage error when determining the drainage error (S630).

For example, the controller 210 may determine whether there is a drainage error, based on the water level sensor information of the laundry treatment machine 100 and drainage completion time information.

For example, the controller 210 may determine that the drainage operation is not smoothly performed and a drainage error occurs, when a certain time is elapsed over a certain time or more after the drainage operation, and the water level of the laundry treatment machine 100 is higher than or equal to a certain water level.

Accordingly, when it is determined that the drainage error occurs, the controller 210 may determine that contamination of the washing tub 120 of the laundry treatment machine 100 occurs.

In particular, the controller 210 may determine that the degree of contamination of the washing tub 120 of the laundry treatment machine 100 increases, as time elapses from the time at which the drainage error occurs.

Meanwhile, when the drainage error is detected, the controller 210 may control to stop the operation of the laundry treatment machine 100 (S632).

Meanwhile, the processor 570 in the server 500 may determine whether there is a drainage error, based on the water level sensor information of the laundry treatment machine 100 and the drainage completion time information.

For example, when a certain time or more is elapsed after the drainage operation, and the water level of the laundry treatment machine 100 is higher than or equal to a certain level, the processor 570 may determine that drainage is not smoothly performed and a drainage error is occurred.

Accordingly, when it is determined that the drainage error is occurred, the processor 570 may determine that contamination of the washing tub 120 of the laundry treatment machine 100 occurs.

Accordingly, the processor 570 may generate tub washing schedule information for washing the washing tub 120 so as to remove contamination of the washing tub 120 due to drainage error.

For example, the processor 570 may bring the schedule in the tub washing schedule information forward, as the contamination of the washing tub 120 becomes worse.

Meanwhile, based on the received water level sensor information, the processor 570 grasps the state of the laundry treatment machine 100 through the machine learning or deep learning based learning, generate data for the operation of the laundry treatment machine 100, and provide the generate data to the laundry treatment machine 100, the mobile terminal 600, or the like.

For example, when determining a subsequent drainage error by using the tub washing schedule information at the time of determining a first drainage error, based on the received water level sensor information, the processor 570 can quickly generate and output the tub washing schedule information through machine learning or deep learning based learning.

Meanwhile, the communicator 535 in the server 500 transmits the generated tub washing schedule information to the laundry treatment machine 100 (S634).

Accordingly, the communicator 270 in the laundry treatment machine 100 receives the tub washing schedule information (S635).

Next, the controller 210 in the laundry treatment machine 100 controls to display the tub washing schedule information through the display 118 (S641).

Next, the controller 210 in the laundry treatment machine 100 controls to perform a tub washing for washing the washing tub 120 at a corresponding timing, according to the received tub washing schedule information (S645).

In particular, the controller 210 in the laundry treatment machine 100 may control to perform the washing tub for washing the washing tub 120 at a corresponding timing, according to the received washing schedule information, after the drainage error is removed. Accordingly, it is possible to automatically wash the washing tub after the drainage error occurs.

Meanwhile, when a power key is operated in a state where the drainage error is detected, the laundry treatment machine 100 is turned off. When an operation pause key is operated in the state where the drainage error is detected, the laundry treatment machine 100 may change the operation stop state into the pause state.

Meanwhile, the controller 210 of the laundry treatment machine 100 may remove the display of the drainage error information displayed on the display 118, when the operation pause key is operated in a state where the drainage error is detected.

Figure 7:
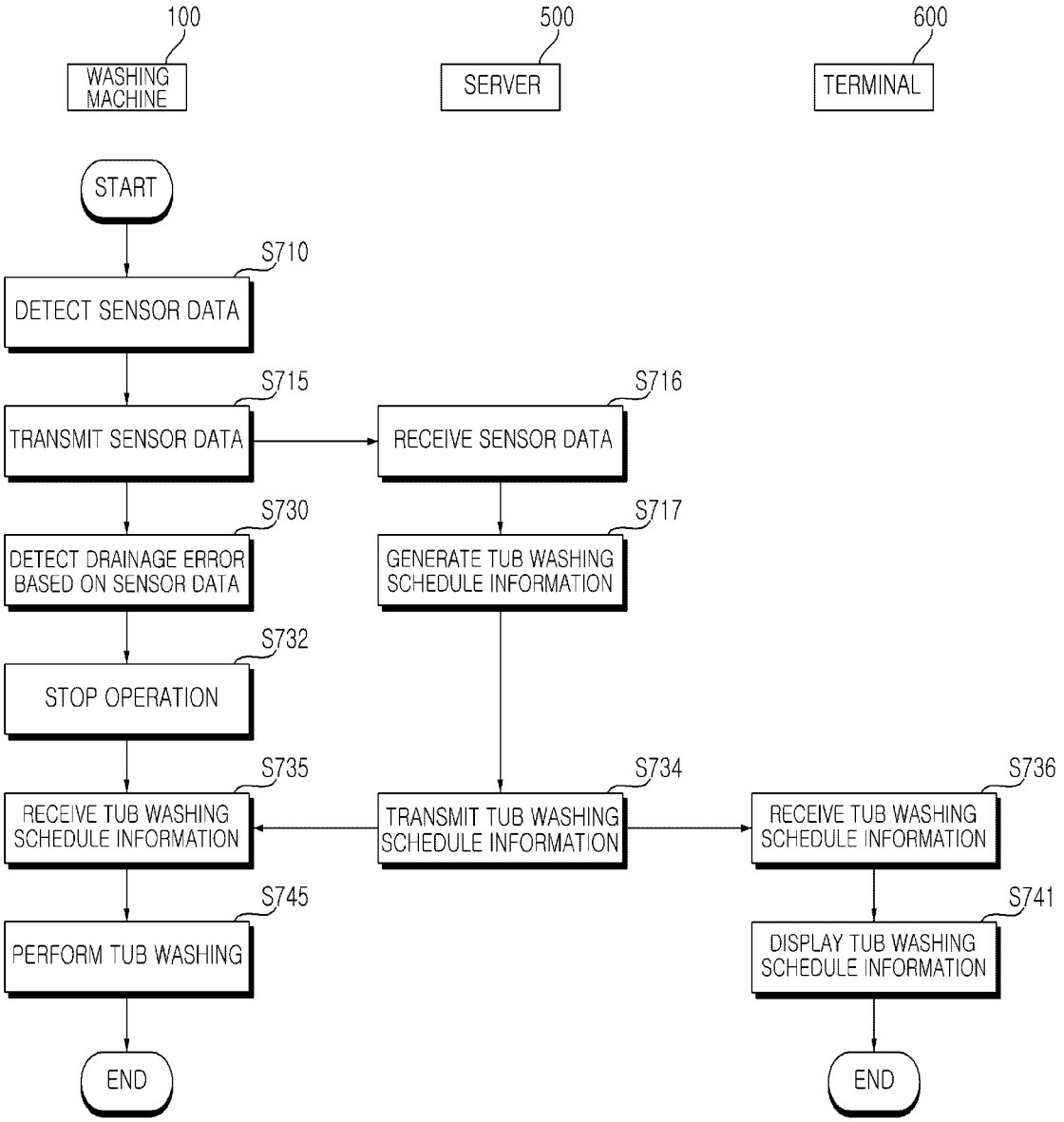
FIG. 7 is a flowchart illustrating an operating method of a laundry treatment system according to another embodiment of the present disclosure.

FIG. 7 is a flowchart illustrating an operating method of a laundry treatment system according to another embodiment of the present disclosure.

The operation method of FIG. 7 is almost similar to the operation method of FIG. 6.

Accordingly, steps 610 (S610) to 645 (S645) of FIG. 6 may correspond to steps 710 (S710) to 745 (S745) of FIG. 7 (S745).

According to the operation method of FIG. 7, the laundry treatment machine 100 of FIG. 6 may omit to display the tub washing schedule information. However, unlike FIG. 7, the laundry treatment machine 100 may display the received tub washing schedule information.

Meanwhile, according to the operating method of FIG. 7, the server 500 may transmit the tub washing schedule information to the mobile terminal 600 in addition to the laundry treatment machine 100 (S736). In addition, the mobile terminal 600 may display the received tub washing schedule information (S741).

Therefore, through the laundry treatment machine 100 and the remotely positioned mobile terminal 600, the tub washing schedule information after the drainage error can be simply checked.

FIGS. 8 to 11 are diagrams for explaining the operating method of FIG. 6 or 7.

Figure 8:
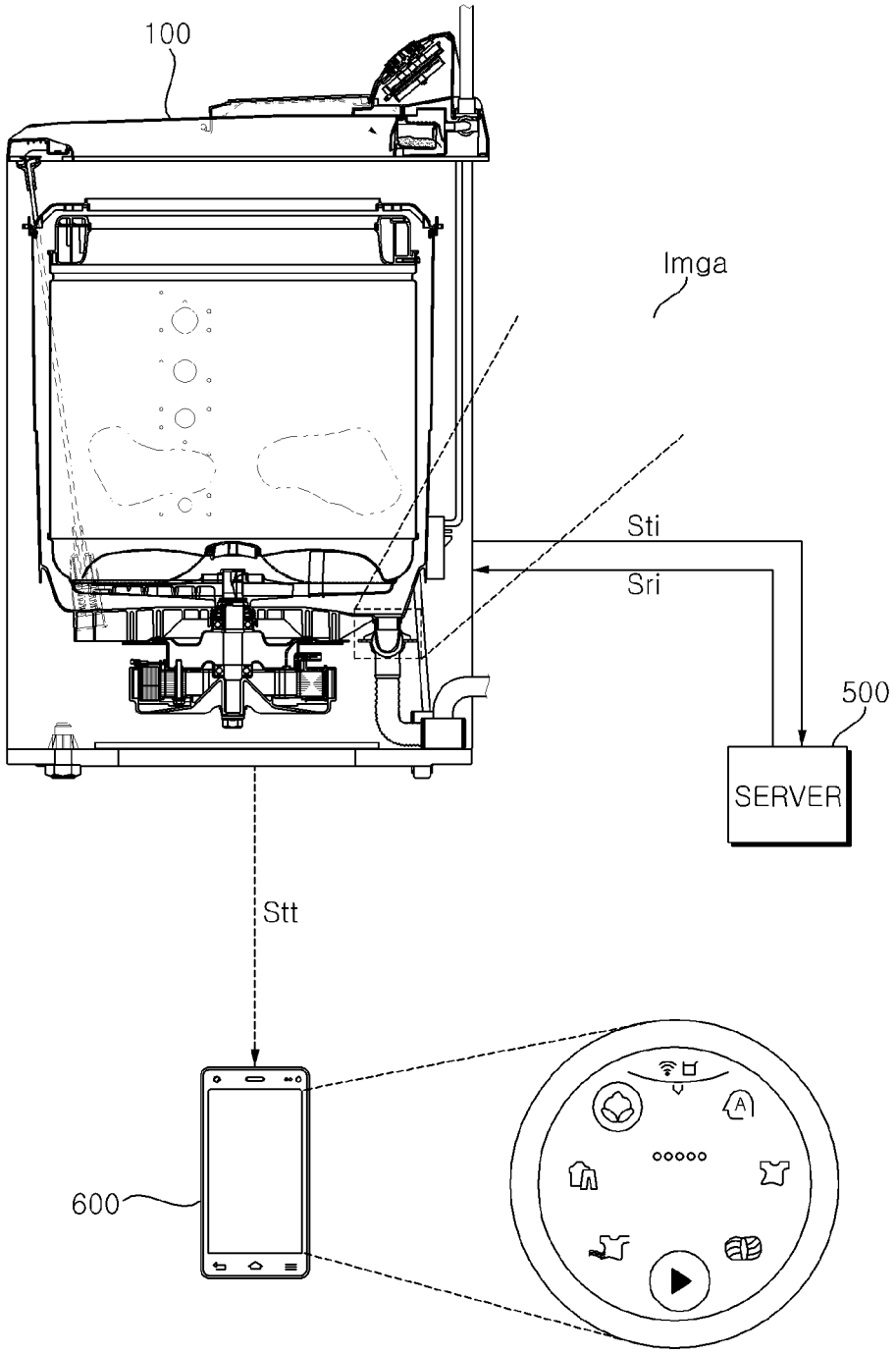

FIG. 8 illustrates an image related to a drainage error near the drainpipe of the laundry treatment machine 100.

When the drainage error occurs, contamination occurs in the washing tub 120, or the like.

Meanwhile, the laundry treatment machine 100 may transmit information Sti including sensor data and device-related data to the server 500.

The server 500 may determine whether there is a drainage error, based on the sensor data, particularly, on the water level sensor data.

When the drainage error is detected, the server 500 may generate the tub washing schedule information Sri and transmit the generated information to the laundry treatment machine 100.

The laundry treatment machine 100 may display the tub washing schedule information Sri or display washing tub cleaning course information related to the tub washing schedule information, according to the received tub washing schedule information Sri.

In addition, the laundry treatment machine 100 may transmit the tub washing schedule information Sri or the washing tub cleaning course information to the mobile terminal 600.

Accordingly, through the mobile terminal 600, it is possible to easily grasp the tub washing schedule information Sri or the washing tub cleaning course information.

In addition, through the mobile terminal 600, user can change the schedule of the tub washing schedule information.

The laundry treatment machine 100 may perform automatic cleaning of the washing tub, according to the tub washing schedule information Sri or the washing tub cleaning course information, after the drainage error is removed and the normal operation can be accomplished.

Alternatively, the laundry treatment machine 100 may perform automatic cleaning of the washing tub according to the modified tub washing schedule information, through the mobile terminal 600 that received the tub washing schedule information.

FIG. 9 is a diagram illustrating an example of information Sti transmitted from the laundry treatment machine 100 to the server 500.

For example, the information Sti transmitted to the server 500 may include date and time information (CREATE_DT), product identification information (DEVICE_ID), and field information (Error_Code) for checking whether an error has occurred in the product.

In this case, among the field information for checking whether an error has occurred in the product, '1' may indicate drainage error information, '0' may indicate no error, and '2' may indicate a water supply error.

That is, the information Sti transmitted to the server 500 may include at least one of drainage error information, no error information, and water supply error information.

Figure 10:
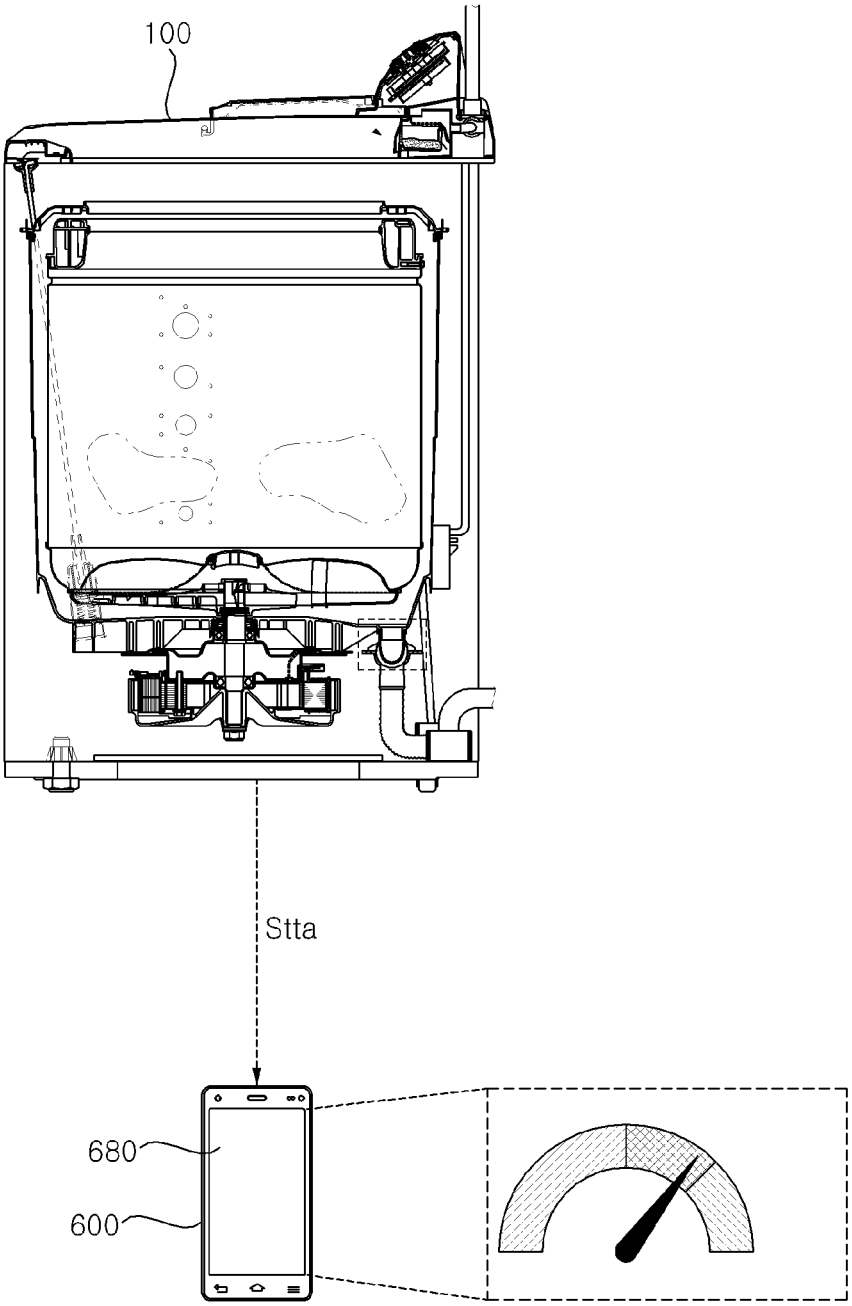

FIG. 10 illustrates that certain information Stta is transmitted from the laundry treatment machine 100 to the mobile terminal 600, after receiving the tub washing schedule information, according to the drainage error. For example, the information Stta transmitted from the laundry treatment machine 100 to the mobile terminal 600 may include at least one of drainage error occurrence time information, tub washing schedule information, description information related to washing tub contamination possibility, information that can be solved by tub washing, and information that can not be solved by tub washing. Accordingly, the user can easily grasp various information, after the drainage error, through the mobile terminal 600.

Meanwhile, FIG. 11 illustrates an example of information transmitted from the server 500 to the laundry treatment machine.

Referring to the drawing, the information transmitted from the server 500 to the laundry treatment machine includes data reception time information (CREATE_DT), data version information (SDS_ver1), error type information (Error_Code), and course information (CourseInfo) of the laundry treatment machine.

Meanwhile, the information of FIG. 11 may be an example of data transmitted from the laundry treatment machine to the server 500.

Meanwhile, in FIG. 1A, the laundry treatment machine is illustrated as a top load type, but the driving apparatus 620 of the drain pump according to the embodiment of the present disclosure can be applied to a front load type, i.e., a drum type.

The laundry treatment machine according to the embodiment of the present disclosure includes: a washing tub; a motor configured to supply rotational force to the washing tub; a water level sensor configured to detect a water level of the washing tub; a communicator configured to transmit data to a server or receive data from the server; and a controller server configured to control to stop operation, when a drainage error is detected during drainage operation of the washing tub, and, when tub washing schedule information is received from the server through the communicator, to control to perform operation to wash the washing tub based on the tub washing schedule information. Accordingly, it is possible to automatically wash the washing tub after the drainage error occurs. In particular, according to the schedule information, it is possible to perform the washing of the washing tub in the case of drainage error.

Meanwhile, the laundry treatment system according to the embodiment of the present disclosure includes: a laundry treatment machine comprising a washing tub, a water level sensor configured to detect a water level of the washing tub, and a communicator configured to communicate with a server; and the server configured to receive water level sensor information from the laundry treatment machine, and to generate tub washing schedule information based on the water level sensor information, wherein the laundry treatment machine performs operation of washing the washing tub based on the tub washing schedule information when the tub washing schedule information is received from the server. Accordingly, it is possible to automatically wash the washing tub after the drainage error occurs.

The laundry treatment machine and the laundry treatment system having the same according to the embodiment of the present disclosure are not limited to the configuration and method of the embodiments described above, but all or some of each of the embodiments may be selectively combined so that the embodiments can be modified in various ways.

Although the embodiments of the present disclosure have been disclosed for illustrative purposes, those skilled in the art will appreciate that various modifications, additions and substitutions are possible, without departing from the scope and spirit of the invention as disclosed in the accompanying claims. Accordingly, the scope of the present disclosure is not construed as being limited to the described embodiments but is defined by the appended claims as well as equivalents thereto.

What is claimed is:

1. A laundry treatment machine comprising:

a washing tub;

a motor configured to supply rotational force to the washing tub;

a water level sensor configured to detect a water level of the washing tub;

a transceiver configured to transmit water level sensor data detected by the water level sensor to a server or receive data from the server; and a controller configured to control to stop operation, when a drainage error is detected during drainage operation of the washing tub or when detection information of the drainage error is received from the server, and, when tub washing schedule information is received from the server through the transceiver, perform tub washing for washing the washing tub at a corresponding timing based on the tub washing schedule information, wherein the controller is configured to determine that drainage error occurs when a certain time is elapsed over a certain time or more after the drainage operation, and the water level of the washing tub is higher than or equal to a certain water level, wherein after receiving the tub washing schedule information, the transceiver transmits at least one of drainage error occurrence time information, the tub washing schedule information, description information related to washing tub contamination possibility, information solved by tub washing, and information not solved by tub washing to a mobile terminal.

2. The laundry treatment machine of claim 1, further comprising a display configured to display information related to laundry, wherein the controller controls the display to display drainage error information, when the drainage error is detected.

3. The laundry treatment machine of claim 1, further comprising an input device including a power key and an operation pause key, wherein power is turned off when the power key is operated in a state in which the drainage error is detected, and when the operation pause key is operated in the state in which the drainage error is detected, operation stop state is changed to pause state.

4. The laundry treatment machine of claim 3, further comprising a display configured to display information related to laundry, wherein the controller controls the display to display drainage error information, when the drainage error is detected, and wherein the controller removes display of the drainage error information displayed on the display, when the operation pause key is operated in the state in which the drainage error is detected.

5. The laundry treatment machine of claim 1, wherein the transceiver transmits detection information of the drainage error or the tub washing schedule information to the mobile terminal, when the drainage error is detected.

6. A laundry treatment system comprising:

a laundry treatment machine comprising a washing tub, a water level sensor configured to detect a water level of the washing tub, and a transceiver configured to communicate with a server; and the server configured to receive water level sensor information from the laundry treatment machine, and to generate tub washing schedule information based on the water level sensor information, wherein the laundry treatment machine is configured to:

transmit water level sensor data detected by the water level sensor to the server or receive data from the server;

control to stop operation, when a drainage error is detected during drainage operation of the washing tub or when detection information of the drainage error is received from the server;

when the tub washing schedule information is received from the server, perform tub washing for washing the washing tub at a corresponding timing based on the tub washing schedule information;

determine that drainage error occurs when a certain time is elapsed over a certain time or more after the drainage operation, and the water level of the washing tub is higher than or equal to a certain water level; and after receiving the tub washing schedule information, transmit at least one of drainage error occurrence time information, the tub washing schedule information, description information related to washing tub contamination possibility, information solved by tub washing, and information not solved by tub washing to a mobile terminal.

7. The laundry treatment system of claim 6, wherein the server comprises:

a second transceiver configured to receive the water level sensor information from the laundry treatment machine; and a processor configured to generate the tub washing schedule information based on the water level sensor information, wherein the second transceiver transmits the tub washing schedule information to the laundry treatment machine.

8. The laundry treatment system of claim 7, wherein the processor detects whether the drainage error occurs, based on the water level sensor data from the water level sensor and the drainage completion time information, and generates the tub washing schedule information, when the drainage error is detected.

9. The laundry treatment system of claim 7, wherein the transceiver of laundry treatment machine transmits tub washing schedule information to the mobile terminal.

* * * * *